US009481941B2

(12) United States Patent
Floner et al.

(10) Patent No.: US 9,481,941 B2
(45) Date of Patent: Nov. 1, 2016

(54) METHOD FOR THE TREATMENT, BY PERCOLATION, OF A FELT ELEMENT BY MEANS OF ELECTRODE-POSITION

(71) Applicants: UNIVERSITE DE RENNES I, Rennes (FR); CNRS-Centre National de la Recherche Scientifique, Paris (FR)

(72) Inventors: Didier Floner, Servon sur Vilaine (FR); Florence Geneste, Servon sur Vilaine (FR); Dominique Paris, Vern sur Seiche (FR); Olivier Lavastre, Gahard (FR)

(73) Assignees: UNIVERSITE DE RENNES, Rennes (FR); CNRS-CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 513 days.

(21) Appl. No.: 14/098,661

(22) Filed: Dec. 6, 2013

(65) Prior Publication Data

US 2014/0183048 A1 Jul. 3, 2014

Related U.S. Application Data

(63) Continuation of application No. PCT/EP2012/060926, filed on Jun. 8, 2012.

(30) Foreign Application Priority Data

Sep. 6, 2011 (FR) ..... 11 55040

(51) Int. Cl.

| | |
|---|---|
| ***C25D 5/54*** | (2006.01) |
| ***C25D 5/08*** | (2006.01) |
| ***C25D 7/00*** | (2006.01) |
| ***C25D 5/02*** | (2006.01) |
| ***C25D 5/18*** | (2006.01) |

(52) U.S. Cl.
CPC . *C25D 5/08* (2013.01); *C25D 5/02* (2013.01); *C25D 5/18* (2013.01); *C25D 5/54* (2013.01); *C25D 7/00* (2013.01)

(58) Field of Classification Search
CPC ..... C25D 5/08; C25D 7/00
USPC ..... 205/150, 160–161; 204/284
See application file for complete search history.

(56) References Cited

U.S. PATENT DOCUMENTS 3,616,286 A * 10/1971 Aylward ..... H01M 4/8807 204/228.6
5,690,806 A 11/1997 Sunderland

FOREIGN PATENT DOCUMENTS

FR 2846012 A1 4/2004
WO 2000048202 A1 8/2000

OTHER PUBLICATIONS

The English translation of the International Search Report dated Aug. 6, 2012.
Pilone, et al., "Model of Multiple Metal Electrodeposition in Porous Electrodes," Journal of the Electrochemical Society, vol. 153, No. 5, Jan. 1, 2006, pp. D85-D90.
The French International Search Report dated Aug. 6, 2012.

* cited by examiner

*Primary Examiner* — Nicholas A Smith
*Assistant Examiner* — Brian W Cohen
(74) *Attorney, Agent, or Firm* — Thomas Horstemeyer, LLP

(57) ABSTRACT

Embodiments of the present disclosure provide for methods for manufacturing a metallized or metallizable felt by percolation of at least one felt element by electrodeposition.

12 Claims, 3 Drawing Sheets

METHOD FOR THE TREATMENT, BY PERCOLATION, OF A FELT ELEMENT BY MEANS OF ELECTRODE-POSITION

CROSS REFERENCE TO RELATED APPLICATION

This application is a continuation of PCT Application entitled "Method for the Treatment, By Percolation, Of A Felt Element By Means Of Electrode-Position," having serial number PCT/EP2012/060926, filed on 8 Jun. 2012, which claims priority to and benefit of French Patent Application No. 1155040, filed on 9 Jun. 2011, both of which are incorporated by reference in their entirety.

1. FIELD OF THE INVENTION

The field of the invention is that of metallized or metallizable porous materials. More specifically, the invention pertains to a technique for treating a metallized or metallizable porous material leading to its metallization.

2. PRIOR ART

Metallized or metallizable porous materials are materials that offer high specific surface area for reduced volume. The materials of this type find application in numerous industrial fields such as the manufacture of accumulators, fuel cells and filters. Thus, such materials can be used especially to collect pollutant ions from wastewater.

Metallized porous materials include especially metallized felts which have valuable characteristics of porosity. However, their specific surface area and their thickness are often limited by the method of their manufacture. Now, the utility of the use of these felts is related to the specific surface area that they offer. It is with this goal in view that the present Applicant has developed the method for metallizing graphite felt described in the patent document FR-A1-2846012. This document describes a method of electrodeposition by which the fibers of a graphite felt are coated with a thin layer of metal of the order of 1 micrometer. The graphite felt, acting as an inert electrode, and an electrically connected counter electrode are plunged into a vessel of electrolyte solution formed by metal ion salt. Under the effect of the current applied to the electrodes, the metal ions in solution get deposited on the felt fibers according to the following reaction: $M^{n+}+ne^{-}\rightarrow M$, in which M designates a metal chosen from among nickel, cobalt and copper. The technique then consists in making the electrolyte solution pass through a layer of felt until said solution is exhausted.

According to this method, the electrolysis time needed to achieve full metallization throughout the thickness of the layer of felt is very lengthy. For example, the electrolysis time needed to metallize felt with a diameter of 4 cm having a thickness of 3 mm is 48 hours.

This gives rise to considerably lengthy periods and corresponding energy expenditure.

Furthermore, the quantities of metal salts to be used are great, of the order of $10^{-2}$ to $10^{-1}$ mol/L.

Besides, the prior-art technique, known as the stationary or exhaustion method, leads to a thicker metal deposit on the faces of the felt. The felt thus obtained does not have a perfectly homogenous metallization between the faces of the felt and the interior.

In addition, to prevent excess metallization, the surfaces of the felt layer must be coated with a thin layer of non-conductive porous material such as a layer of filter paper. Now, it is often difficult to remove this filter paper after metallization because of its strong adhesion to the felt following the electrodeposition. This strong adhesion also causes non-metallization zones on the surface. This leads to a deterioration of the homogeneity of the metallization. In other words, it can happen that the thickness of the metallization layer is not identical on all the fibers of the felt.

3. GOALS OF THE INVENTION

The invention is aimed especially at overcoming all or part of the drawbacks of the prior art mentioned here above.

It is a goal of the invention, in at least one embodiment, to provide a technique for fabricating a layer of felt making it possible to obtain a layer of felt having an essentially homogenous metallization.

It is another goal of the invention, in at least one embodiment, to propose a technique of this kind that is relatively economical to implement at least as compared with the expenditure entailed in the prior-art technique.

In particular, the invention, in at least one embodiment, seeks to obtain a technique that can be implemented by consuming less energy than in the prior art.

It is another goal of the invention, in at least one embodiment, to make it possible to obtain savings of reagents as compared with the prior art.

It is also a goal of the invention, in at least one embodiment, to propose a technique of metallization by electrodeposition that is faster to implement than the prior art technique.

It is yet another goal of the invention, in at least one embodiment, to avoid having to resort to the use of filter paper to protect the surface of the felt during the electrodeposition.

It is another goal of the invention, in at least one embodiment, to propose a technique of this kind that is more reliable, more efficient and easier to implement.

4. SUMMARY OF THE INVENTION

These goals, as well as others that shall appear more clearly here below, are achieved by means of a method for manufacturing a metallized or metallizable felt by percolation of at least one felt element by electrodeposition.

According to the invention, such a method comprises:

- a step for maintaining said at least one felt element in a metallization reactor comprising a support, wholly or partly made of electrically conductive material, for said at least one felt element and defining a first compartment and a second compartment separated by said at least one felt element, said support being electrically linked to a counter-electrode;
- a step in which an electrolyte solution comprising at least one electroactive metal ion salt is made to travel through said at least one felt element;
- a step for making at least one electric current pass through said at least one felt element;
- said step for making an electrolyte solution travel through said at least one felt element consisting in making at least a part of this electrolyte solution pass at least once in a direction going from said first compartment to said second compartment and in the reverse direction going from the second compartment to said first compartment of said metallization reactor.

Thus, the invention relies on a wholly original approach in which electroactive metal ions are deposited on a felt element in making it pass through a solution of electroactive ions at least once in one direction and then in the other direction.

The method according to the invention makes it possible to obtain a layer of felt, the metallization of which is of higher quality. Indeed, during the passage of the electrolyte solution through a first face of the felt, the metal ions get deposited according to a gradient of concentration. In other words, the electrolyte solution gradually gets exhausted in metal ions as and when it passes through the felt. The metal deposit is then thicker on the surface of the first face of the felt than on the second face of the felt. The passage of the electrolyte solution in the reverse direction, i.e. from the second face of the felt to the first, also leads to a metal deposit that is thicker on this second face than on the first. Finally, a metallized felt is obtained homogenously on each of these faces.

The homogeneity of the deposit is assessed in practice by two criteria:

- a visual criterion: the operator checks that all the fibers of the felt are metallized. He verifies especially that there are no non-metallized fibers or that, on the contrary, there is no area having an excessively thick deposit as compared with the other fibers of the felt; and
- an analytical criterion: an analysis by scanning electron microscopy (SEM) shows, for a homogenous metallization, a small difference of thickness of the deposit between the fibers situated on the surface and those situated deep inside the felt.

Through the invention, the thickness of the metal deposit obtained on the fibers within the layer of felt and that obtained on the fibers on the surface of the felt are highly homogenous, i.e. they have a substantially equal thickness. This was not the case with the prior art methods. In particular, no zone of non-deposit was observed with SEM. Now, the sensitivity of SEM, which is in the range of 10 nanometers, is much more precise than in the case of the normal variations in thickness of the metal deposit which are of the order of some hundreds of nanometers to a few microns.

Finally, this method can equally well be applied to:

- felts for which the fibers are bare in the sense that they are not already coated with a metal layer; and
- felts for which the fibers have already received a first layer of a metal and are already metallized and on which is desired to apply a second layer of a metal.

Advantageously, the first compartment is placed in fluid communication with a first tank and the second compartment is placed in fluid communication with a second tank, the electrolyte solution travelling at least once via the compartments of the frame in a path going from the first tank to the second tank and from the second tank to the first tank.

Indeed, according to one advantageous embodiment, the electrolyte solution passes through the felt element in circulating from a first tank to a second tank and then from the second tank to the first tank.

The passage of the electrolyte solution, entirely or partly, in one direction constitutes a cycle of passage. The method of the invention is characterized in that it can comprise a multiplicity of cycles depending on the quantity of metal that is to be deposited on the felt.

Advantageously, the felt element is a graphite felt element. A felt of this type has the advantage of being a low-cost conductive material that is easy to use.

The choice of graphite is particularly valuable for the electrodeposition method. Indeed, carbon has the particular feature of possessing the highest water stability field of all the conductive materials (−1 to 1.5 V/SHE at pH=0). This particular feature makes it possible to work with metal ions for which the standard oxidation-reduction potential $E^0$ is smaller than 0 V/SHE (volts relative to the standard hydrogen electrode). The graphite felts that can be used to implement the method according to the invention are preferably of the type commercially distributed by the firm Le Carbone Lorraine, under the references RVG 4000 or RVG 2000, or by the firm PICA.

As indicated here above, the method may include a preliminary step of pre-metallization of the at least one felt element. This pre-metallization can be done through the method of the invention.

This preliminary step of metallization gives a metallized felt. This metallized felt can again be subjected to the method of the invention to be metallized by a different metal. Indeed, certain metals show weak adhesion to the bare felt fibers. The deposition on these fibers of certain metals is therefore impossible without the preliminary deposition thereon of another metal. This is the case for example with copper: a pre-metallization with nickel proves to be necessary before the felt is subjected to a second metallization by $Cu^{2+}$ions.

The electrolyte solution preferably contains at least one supporting electrolyte salt. The support electrolyte enables the solution to be made more conductive. Advantageously, this supporting electrolyte salt is sodium sulfate $Na_2SO_4$, in a concentration of $5.10^{-2}$ mol/l. Sodium sulfate has the advantage of being a salt that is both low-cost and perfectly inert electrochemically whatever the pH of the reaction. This means that it does not get oxidized, nor is it reduced at the electrodes.

As explained here above, the electrolyte solution comprises electroactive metal ion salts. Indeed, this solution has the function of conveying electroactive metal ions under the effect of the current flowing from the electrodes through the surface of the felt. The term "metal ion" is understood to mean any element belonging to the transition metals except for the lanthanides and the actinides. More exactly, these elements belong to the groups III to XV and to the periods 4 to 7 of the Mendeleev classification. The term "electroactivity" is understood to mean the capacity of an element to exchange electrons during the imposition of an electric current. Preferably, the potential $E^o$ of these electrons must be included in the water stability field in presence of a graphite electrode, i.e. from −1 to 1.5 V/SHE.

The electroactive metal ions that can be implemented in the method of the invention can be chosen from among ions of the following elements: gold, platinum, palladium, mercury, silver, iridium, rhodium, copper, bismuth, rhenium, lead, tin, nickel, vanadium, cobalt, thallium, indium, cadmium, iron, chromium, gallium, zinc and manganese. These ions are associated with a counter-ion to form a salt that is soluble in the electrolyte solution. In one preferred embodiment, the electroactive metal ion is chosen from among elements of the periods 4 to 6 of the periodic table and preferably from among nickel, copper, cobalt, silver, bismuth or lead.

According to the invention, the electrolyte solution has a concentration in electroactive metal ion salt ranging from 50 mg/l to 10 g/l.

The concentration in metal ions is determined according to the rigidity that is to be given to the felt. This concentration will be all the greater as it is desired to obtain a rigid felt, metallized throughout the length of the graphite fibers. The use of a solution weakly concentrated in metal ions leads to a more homogenous metallization between the surface and the depth of the graphite felt. The greater the duration of metallization, the greater the thickness of the metal on each fiber and therefore the more rigid the felt. Conversely, a short metallization time will make it possible to obtain a more flexible felt. This felt will be all the easier to handle and will all the more resistant to the mechanical stresses to which it will be subjected.

The choice of the concentration in metal ions is also done according to the thickness of the felt chosen. The thicker the felt, the lower should the concentration in metal ions be. A high concentration for a thick felt would lead to the formation of a deposit that is thick on the surface but also has small depth. The graphite fibers would not be metallized within the felt and this would harm the porosity and the lightness of the felt. A low concentration gives a homogenous surface metallization. On the contrary, with a high concentration for a fine felt, a rigid felt perfectly metallized throughout the length of the fiber is obtained in a short time.

For example, for a felt with a thickness of 3 mm, the relation between the mechanical properties and the $Ni^{2+}$ concentration to be applied is indicated in Table 1.

TABLE 1

Aspect of the metallization of a graphite felt with a thickness of 3 mm as a function of the concentration in electroactive metal ions

| $[Ni^{2+}]$ | Mechanical properties of the metallized felt |
|---|---|
| 50 mg/l | Flexible |
| 1 g/l | Rigid |

For thicknesses other than 3 mm, Table 3 summarizes the relationship between the thickness of the felt to be metallized and the concentration in nickel ions to be applied.

TABLE 2

Concentration of electroactive metal ions to be applied as a function of the thickness of the felt

| $[Ni^{2+}]$ | Thickness of the felt | | | |
|---|---|---|---|---|
| 50 mg/l | Up to 12 mm | | | |
| 0.5 g/l | | Up to 6 mm | | |
| 10 g/l | | | | Up to 2 mm |

It is indeed preferable to reduce the concentration in $Ni^{2+}$ when working with felts having a thickness of 0.5 cm to 1.2 cm in order to prevent the formation of a metal crust on the surface of the felt. The smaller the thickness of the felt, the greater is the concentration in electroactive ion salt to be implemented. For a felt with a thickness of 2 mm or less, the maximum concentration is 10 g/l. For a felt with a thickness of 12 mm, the highest concentration to be implemented is 0.05 g/l.

This variation in the concentration of electroactive ions as a function of the thickness of the felt is due to the fact that the electrodeposition potential applied to the felt via an imposed current is not homogenous. This potential diminishes as and when a greater depth of the felt is reached. Now, the metallization depends both on the potential of electrodeposition and the concentration in electroactive ions. Consequently, the speed of the deposition is reduced as and when the operation moves into the interior of the felt and on the contrary will be highly favored on the surface.

According to an advantageous embodiment, the invention is implemented with a pH value of 1 to 2 pH units, below the pH value of precipitation of the electroactive ion. In the case of an electrodeposition of nickel ions, the pH is advantageously fixed between 4 and 5. In the case of electrodeposition of copper ions, the pH is fixed between 3 and 4. The pH of the reaction is a major parameter to be controlled. Indeed, depending on the pH, the potential of the oxidation-reduction reaction is shifted towards more or less negative values. Working with a fixed pH, or at least a substantially fixed pH, optimizes the performance of the electrodeposition reaction. A reaction with a higher pH than the optimum pH would cause a precipitation of the metal ions. This phenomenon would cause a slowing down of the kinetics of reaction and a clogging of the felt, thus preventing in-depth electrodeposition.

The pH of the solution can be acidic or basic. An electrodeposition in an acid condition enables the total metallizing of graphite felts with a thickness of the order of one centimeter. A flexible felt is then obtained, that is resistant to deformation and to torsion. An electrodeposition in alkaline condition is to be preferred for felts whose thickness does not exceed 0.6 cm. A basic pH results in a major thickness of the deposit on the surface and a low thickness in depth. Thus, a highly rigid filter with low deformability is obtained. The difference in thickness of the metal deposit in these conditions can then reach a few micrometers between the surface and the interior of the felt. Besides, an alkaline pH limits the release of hydrogen formed by the electrolysis reaction.

In one embodiment of the invention, the electrolyte solution for electrodeposition in acid medium can include sodium sulfate in a concentration of 0.05 mol/l and boric acid in a concentration of 0.1 mol/l. The boric acid has the role of acidifying the medium.

In another embodiment of the invention, electrodeposition can be done in a base medium. In this case, the electrolyte solution can contain sodium sulfate in a concentration of 0.05 mol/l. The pH value of the medium is kept at 9 by the use of a buffer system. This buffer system can be an ammonia buffer constituted by the pair $NH_4^+/NH_3$ at 0.1 mol/l. The pH value of the solution can also be maintained by a concentrated weak base such as a solution of sodium acetate $CH_3COONa$ for example.

The pH value can be adjusted with a few drops of sulfuric acid $H_2SO_4$ at 1 mol/l or sodium hydroxide NaOH at 10 mol/l.

In a base medium, the use of a complexing agent is necessary. Indeed, the electroactive metal ions tend to precipitate at high pH values. In order to make them soluble in a base medium, a ligand is added. The ligand bonds with the metal electroactive metal ion to form a complex soluble in the solution. This complexation does not modify the reactivity of the electroactive ion or its deposition on the surface of the felt. The ligand used can be for example a solution of sodium citrate in a concentration of 0.1 mol/l.

Advantageously, the step for making an electric current pass through at least one felt element is carried out by using an electric current the intensity of which is proportional to the volume of the at least one felt element according to the formula:

$$I = i_k \times V_{felt}$$

where I is the intensity of the current in amperes, $i_k = 0.1\ A/cm^3$ $V_{felt}$ is the volume of the felt in $cm^3$.

As compared with the stationary system, the method of electrodeposition by percolation reduces the intensities to be implemented by a factor of 2.5 approximately.

According to the invention, the method for manufacturing a metallized or metallizable felt by percolation is characterized in that the step for making an electric current pass through said at least one felt element is interrupted by idle times during which the intensity of the current is zero. In other words, the phases for imposing the current during which the intensity I is not zero alternates with idle phases during which the intensity of the current I is zero and during which the concentration in electroactive metal ions is refreshed. The imposing of the current is done therefore according to an alternating mode enabling the electrodeposition to be stabilized. Indeed, the sustained and continuous application of a current would prompt a rapid diminishing of the concentration in metal salts within the felt. A multiple-pulse amperometric method prevents such a phenomenon.

Advantageously, the idle time between each imposition of current is computed according to the relationship:

$$t_r = \frac{V_{felt}}{nd} \times 60$$

where $t_r$ is the idle time between each imposition of current in seconds, $V_{felt}$ is the volume of the felt in $cm^3$, n is an integer, d is the flow rate of the electrolyte solution in ml/min.

The factor n is determined by experiment. For example, for the metallization of a graphite felt by nickel, the relationship between the concentration in $Ni^{2+}$ and the factor n is indicated in the table below:

TABLE 3

Relationship between the factor n and the concentration in nickel ions

| Concentration | $[Ni^{2+}] < 0.5$ | $0.5 \leq [Ni^{2+}] < 5$ | $[Ni^{2+}] \geq 5$ |
|---|---|---|---|
| N | 1 | 2 | 3 |

Advantageously, the time of imposition of the current is computed according to the relationship:

$$t_i = \frac{t_r}{2}$$

where $t_i$ is the time of imposition of the current in seconds, $t_r$ is the idle time between each imposition of current in seconds.

The flow rate of the solution also depends on the volume of the felt to be metallized. In one preferred embodiment, when said at least one felt element has a thickness of 1 mm to 6 mm, the step for making an electrolyte solution pass through at the least one felt element is implemented according to a maximum flow rate of the electrolyte solution, denoted as $d_{max}$, computed as follows:

$$d_{max} = 2 \times V_{felt}/a$$

where $d_{max}$ is expressed in ml/min, $V_{felt}$ is the volume of the felt in $cm^3$, and a is equal to 1 min.

Advantageously, when said at least one felt element has a thickness of 6 mm to 12 mm, the step for making an electrolyte solution pass through the at least one felt element is implemented at a maximum flow rate of electrolyte solution denoted as $d_{max}$, computed as follows:

$$d_{max} = V_{felt}/a$$

where $d_{max}$ is expressed in ml/min, $V_{felt}$ is the volume of the felt in $cm^3$, and a is equal to 1 min

5. LIST OF FIGURES

Other features and advantages shall appear from the following description of a preferred embodiment given by way of a simple illustratory and non-exhaustive example and from the appended drawings, of which:

6. DESCRIPTION OF ONE EMBODIMENT OF THE INVENTION

The examples given here below are given by way of an indication and in no way limit the scope of the present invention.

6.1 General Principle of the Invention

The general principle of the invention relies on a technique for manufacturing a metallized or metallizable felt by electrodeposition of electroactive metal ions on a felt element according to which a solution of electroactive ions passes through a felt element at least in one direction and then in the other. The fact of making the solution flow at least once through each face of the felt gives a metallization of homogeneous quality.

6.2 Device for Implementing the Invention

A metallization device for implementing a method according to the invention shall now be described with reference to FIGS. 1 to 6.

Such a device comprises a metallization reactor also known as a percolation cell 10.

Figure 1:
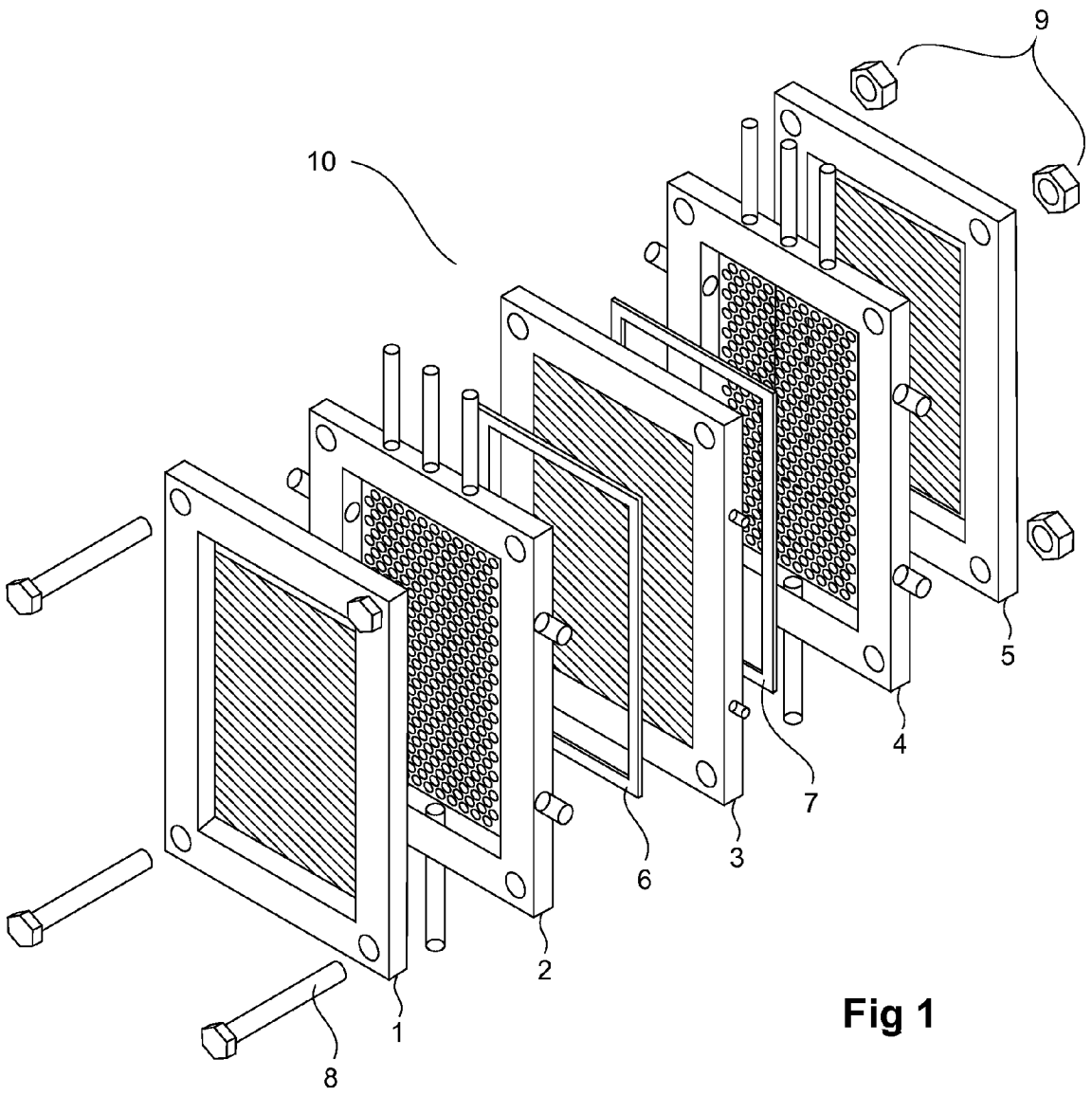
FIG. 1 illustrates an exploded view of a metallization reactor of a device for implementing the method of the invention.

As shown in FIG. 1, a metallization reactor comprises a stack comprising:

a first counter electrode 1;

a first inlet or outlet compartment 2 for an electrolyte solution;

a first seal 6;

a felt support 3;

a second seal 7;

a second inlet or outlet compartment 4 for an electrolyte solution;

a second counter electrode 5.

The counter electrodes 1 and 5 are strictly identical. Only the first counter electrode 1 is described in detail with reference to FIG. 2.

Figure 2:
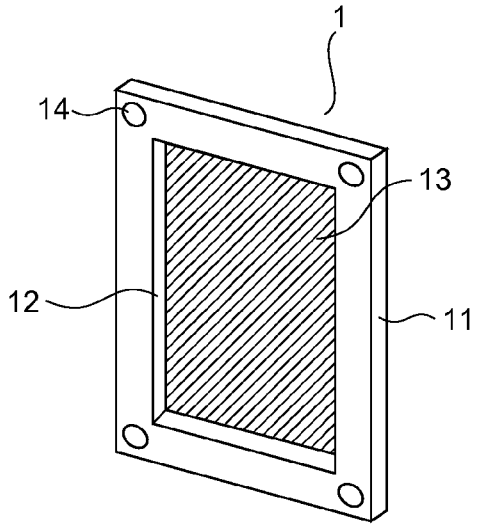
FIG. 2 illustrates a view in perspective of a counter-electrode of the device illustrated in FIG. 1.

As shown in FIG. 2, such a counter electrode 1 comprises a frame 11. The counter electrode 1 is non-corrodible under oxidation.

The frame 11 in this embodiment is essentially quadrangular. It is made out of a non-conductive material and defines an internal housing 12.

The internal housing 12 houses a conductive plate 13. The conductive plate 13 is fixedly attached all along its periphery to the frame 12 in a tightly-sealed manner.

Each corner of the frame 12 is has fastening pierced holes 14 passing through it.

The first and second inlet or outlet compartments 2 and 4 respectively are identical. Only the first compartment 2 is described with reference to FIG. 3.

Figure 3:
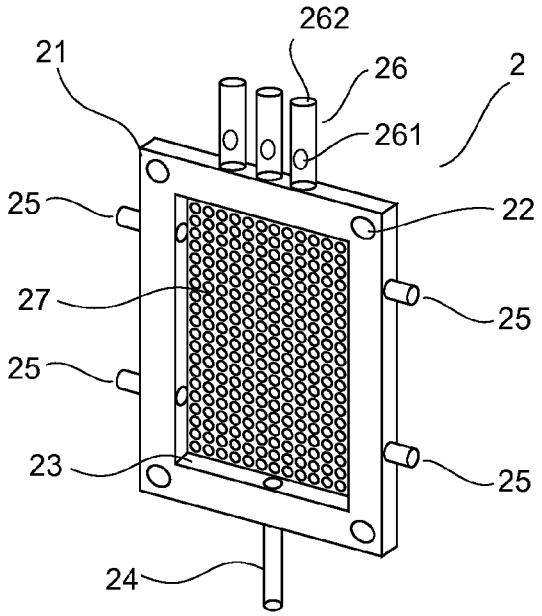
FIG. 3 illustrates a view of an inlet or outlet compartment for the electrolyte solution of the device illustrated in FIG. 1.

As shown in this FIG. 3, an inlet or outlet compartment 2 of this kind has a framing 21 which, in this embodiment, is essentially quadrangular.

This framing 21 has dimensions substantially identical to those of the frame 11 of the counter-electrodes 1, 5. It is made out of a non-conductive material. It is crossed at each of its corners by fastening orifices 22. It defines a central recess 23. The central recess 23 houses a screen 27 which is fixedly attached all along its periphery to the framing 21.

The framing 21 is crossed by lower inlets 24 and lateral inlets 25 for electrolyte solution, as well as upper outlets 26 for the electrolyte solution and gas. The outlets 26 comprise a discharge unit 261 for electrolyte solution and a discharge unit 262 for gas as can be seen more clearly in FIG. 6. It is important that the volume of discharge of the solution should be greater than that of the inlet in order to eliminate the gases formed during electrolysis. If not, the gases formed would be discharged at irregular intervals under the effect of the pressure exerted by the liquid. A pocket of gas would then be created in the upper part of the surface of the felt, preventing the phenomenon of electrodeposition and harming the quality of the metallization.

Figure 4:
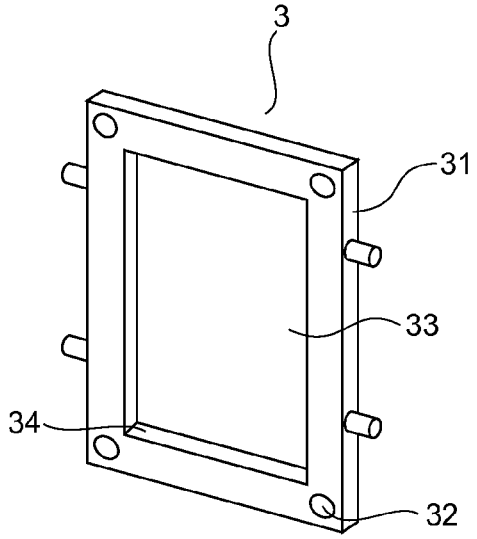
FIG. 4 illustrates a view in perspective of a support of a felt element of the device illustrated in FIG. 1.

As can be seen in FIG. 4, the felt support 3 comprises a chassis 31 which, in this embodiment, is essentially quadrangular.

Figure 5:
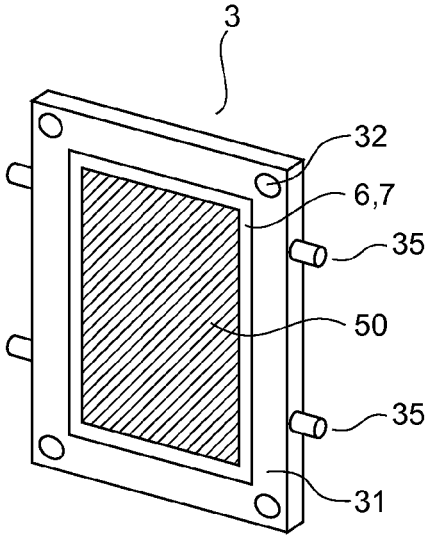
FIG. 5 illustrates a view in perspective of the support illustrated in FIG. 4 in which a felt is inserted.

This chassis 31 has dimensions substantially identical to those of the frame of the counter-electrodes 1, 5 and the framing 21 of the first and second compartments 2 and 4. It is made out of a non-conductive material. It is crossed at each of its corners by fastening holes 32. It defines a central housing 33. The central housing 33 is intended for housing the felt element 50 to be metallized as can be seen in FIG. 5. The rim of the central housing 33 is coated with a conductive band 34. Conductive rods 35, projecting out of the chassis 31, pass through two opposite sides of the frame 31 until they come into contact with the conductive band 34. The conductive band 34 and the rods 35 are preferably made out of a same conductive metallic material, for example copper.

The seals 6 and 7 are identical. They are made out of a non-conductive material resistant to wear and tear and to repeated contact with an electrolyte solution and with electrodeposition reactions, and are made for example of rubber. Their implementation prevents the electrodeposition of metal ions on the conductive band 34.

The metallization reactor 10 is assembled as follows.

The following are stacked respectively on the first counter-electrode 1: the first compartment 2, the first seal 6, the support 2 within which the felt to be metallized 50 will have been preliminarily inserted, the second seal 7, the second compartment 4 and the second counter electrode 5. They are stacked in such a way that the pierced holes 14, the orifices 22 and the fastening holes 32 are facing one another.

Screws 8 are then introduced into the pierced holes 14, the orifices 22, and the fastening holes 32. The final assembly is obtained by means of bolts 9.

The screens 27 of the compartments 2 and 4 act as supports on either side of the felt 50 to hold it in the support 3.

Figure 6:
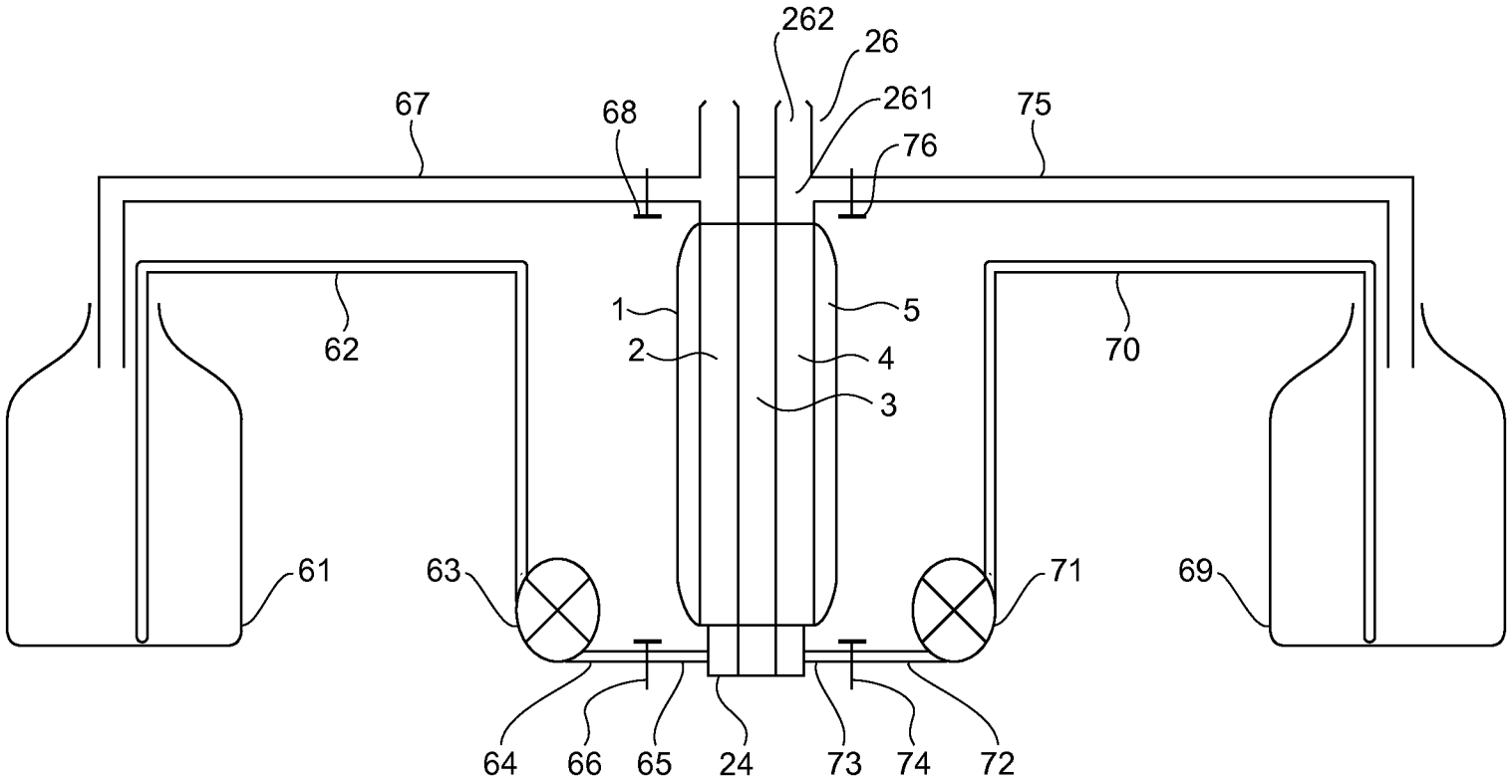
FIG. 6 illustrates a device for implementing a method according to the invention.

As shown in FIG. 6, the metallizing device comprises a first tank of electrolyte solution 61.

The tank 61 is connected by a pipe 62 to a pump 63. The pump 63 is connected by a tube 64 to a network of pipes 65. A valve 66 is interconnected between the tube 64 and the network of pipes 65. The network of pipes 65 is connected to the lower inlet 24 and side inlet 25 of electrolyte solution of the first compartment 2. The discharge elements 261 for removing electrolyte solution from the first compartment 2 are connected to tubes 67 which open into the tank 61. Valves 68 are mounted on the tube 67.

The metallization device comprises a second tank of electrolyte solution 69.

The tank 69 is connected by a pipe 70 to a pump 71. The pump 71 is connected by a tube 72 to a network of pipes 73. A valve 74 is interconnected between the tube 72 and the network of pipes 73. The network of pipes 73 is connected to the lower inlet 24 and lateral inlet 25 for the electrolyte solution of the second compartment 4. The discharge elements 261 for removing electrolyte solution from the second compartment 4 are connected to tubes 75 which open into the tank 69. Valves 76 are mounted on the tubes 75.

The discharge elements 262 for removing gas from the first compartment 2 and second compartment 4 are opened to the exterior.

The device comprises a means for generating an electric current (not shown), for example a potentiostat, capable of delivering a DC current. The conductive rods 32 and the counter-electrodes 1, 5 are electrically connected to the means for generating an electric current.

The device also comprises means for controlling pumps, valves, the means for generating an electric current and the polarity of the counter-electrodes (not shown).

6.3 Implementation of a Method According to the Invention

The implementation of a method for treatment by metallization of a felt according to the invention shall now be described.

Such a method comprises a step in which the felt 50 to be metallized is inserted into the central housing 33 of the support 3. The metallization reactor 10 is then assembled as already explained here above.

The control means are implemented so as to open the valves 66 and 76 and close the valves 68 and 74.

The pump 63 is put into operation in such a way that the electrolyte solution contained in the tank 61 circulates in the pipe 62, the tube 64, the network of pipes 65 towards the inlets 24, 25 of the first compartment 1. The electrolyte solution then flows in the central recess 23 of the first compartment 2 and then passes through the screen 27 and the felt 50 until it penetrates the central recess 23 of the second compartment 4. The electrolyte solution then circulates through the discharge elements 261 and then into the tube 75 to flow into the second tank 69.

At the same time, the means for generating an electric current are implemented so as to cause electric current to flow between the first counter electrode 1 and the conductive band 34 via the rods 35. In this way, metal ions present in the electrolyte solution get deposited on a first face of the felt to be metallized 50.

The entire electrolyte solution initially contained in the first tank 61 is gradually shed into the second tank 69. In one variant, only a portion of this electrolyte solution can be shed into the second tank.

As soon as the first tank 61 is empty, signifying that a first cycle has been completed, the control means stop the pump 63, shut the valves 66 and 67 and open the valves 74 and 68.

Before the pump 71 is activated, the pH of the electrolyte solution contained in the tank 69 is adjusted by the injection of a few milliliters of a solution of sodium hydroxide in a concentration of 10 mol/l or sulfuric acid in a concentration of 1 mol/l. The electrolyte solution is also adjusted in electroactive metal ion salts by a few millimeters (ml) for concentrated solution. The pH and the concentration in metal ions of the electrolyte solution are therefore checked after each cycle by any method well known to those skilled in the art such as the use of a pH-meter, titration of the metal ions by pH test strips, etc.

The pump 71 is implemented so that the electrolyte solution contained in the tank 69 flows in the pipe 70, the tube 72, the network of pipes 73 towards inlets 24, 25 of the second compartment 4. The electrolyte solution then flows in the central recess 23 of the second compartment 4 and then passes through the screen 27 and the felt 50 until it penetrates the central recess 23 of the first compartment 2. The electrolyte solution then flows through the discharge elements 261 and then into the tube 67 to flow into the first tank 61.

At the same time, the means for generating an electric current are implemented so as to make electric current flow between the second counter electrode 5 and the conductive band 34 via the rods 35. In this way, the metal ions present in the electrolyte solution get deposited on the other face of the felt to be metallized 50.

All the electrolyte solution initially contained in the second tank 69 is gradually shed into the first tank 61. When the second tank 69 is empty, this signifies the completion of a second cycle of passage. A plurality of cycles can be implemented. The pH value and the concentration in metal ions of the electrolyte solution are readjusted between each cycle of passage. In one variant, only a portion of this electrolyte solution can be shed into the first tank.

In parallel with the continuous passage of the electrolyte solution into the metallization reactor from one of the tanks to the other, the intensity of the current applied by the means for generating a current alternates between values of zero and non-zero.

The duration for which the intensity of the current is kept at zero between two impositions of current with an intensity of non-zero is computed according to the following relationship:

$$t_r = \frac{V_{felt}}{nd} \times 60$$

where $t_r$ is the idle time between each imposition of current in seconds, $V_{felt}$ is the volume of felt in $cm^3$, n is an integer, d is the flow rate of the electrolyte solution in ml/min.

The duration of imposition during which the intensity of the current is kept at non-zero is determined according to the following formula:

$$t_i = t_r/2$$

where $t_i$ is the time of imposition of the current in seconds, $t_r$ is the idle time between each imposition of current in seconds.

The intensity of the current delivered by the means for generating an electric current is determined according to the following formula:

$$I = i_k \times V_{felt}$$

where I is the intensity of the current in amperes, $i_k = 0.1\ A/cm^3$ $V_{felt}$ is the volume of the felt in $cm^3$.

The flow rate in the pump 63 and 71 is determined according to the thickness of the felt to be metallized.

When the thickness of the felt ranges from 1 to 6 millimeters, the flow rate $d_{max}$ is determined according to the following formula:

$$d_{max} = 2 \times V_{felt}/a$$

where $d_{max}$ is expressed in ml/min, $V_{felt}$ is the volume of the felt in $cm^3$ a is equal to 1 min.

When the thickness of the felt ranges from 6 to 12 millimeters, the flow rate $d_{max}$ is determined according to the following formula:

$$d_{max} = V_{felt}/a$$

where $d_{max}$ is expressed in ml/min, $V_{felt}$ is the volume of the felt in $cm^3$ a is equal to 1 min.

In one variant, it is conceivable to have only one tank connected to the metallization reactor through two pumps working alternately as explained here above.

6.4 Examples

The following embodiments are given by way of an illustration and are not exhaustive.

Example 1

Metallization of Graphite Felt by Nickel

A graphite felt by Le Carbone Lorraine, reference RVG 2000, is placed in the metallization reactor as described here above. The dimensions of the felt are 24 cm×14 cm×0.3 cm. The volume of the felt is approximately 100 $cm^3$. Two 10-liter tanks are connected to the metallization reactor. A first tank is filled with a solution of nickel sulfate with an $Ni^{2+}$ concentration equal to 150 mg/l. The electrolyte solution also contains a support electrolyte consisting of sodium sulfate with a concentration of 0.05 mol/l as well as boric acid at 0.1 mol/l. The pH factor of this solution is set at 5. The intensity of the current applied is computed according to the following formula:

$$I = i_k \times V_{felt} \text{ with } i_k = 0.1\ A/cm^3.$$

For a felt whose volume is equal to 100 $cm^3$, an intensity equal to 10 A is therefore applied. The time of imposition of the current is 30 seconds followed by an idle time of 60 seconds. The flow rate of the electrolyte solution is kept at 100 ml/min. A cycle of passage corresponds to the passage of 10 liters of solution from a first tank to another, through a surface of the felt. In all, six cycles are carried out. Between each cycle and the next one, the pH factor of the solution is adjusted to 5 by the addition of a few millimeters of a solution of sodium hydroxide at 10 mol/l. The concentration in $Ni^{2+}$ is also adjusted by the addition of a few millimeters of a solution of nickel sulfate with a concentration of 1 mol/l.

Thus, a metallized felt is obtained supporting a mass of nickel equal to 8.82 g, the thickness of the coating of the fibers by nickel being of the order of 100 nm. Using a more concentrated solution leads to a thicker deposition and a less flexible felt. The total time of electrolysis is 600 min comprising 200 min of cumulated electrolysis time and 400 min of cumulated idle time. For a flow rate maintained at 200 ml/min, the same result is obtained for a total electrolysis time of 300 min.

To obtain a same result with a method using a stationary flow according to the prior art, the electrolysis time is 48 hours. It can therefore clearly be seen that the method according to the invention considerably reduces the time of manufacture of a metallized felt. This reduction of the electrolysis time considerably reduces the energy investment needed to arrive at a same result. The method according to the invention is therefore compatible with a large-scale industrial application, contrary to the prior art where the use is restricted to the research laboratory.

A homogenous deposit is observed throughout the surface of the felt.

Example 2

Metallization of a Graphite Felt with Copper

Direct electrodeposition on a graphite felt results in a poor-quality deposit, since copper does not adhere well to graphite fibers. It is therefore necessary to carry out a preliminary metallization of the graphite felt with nickel as described in example 1. For a 6 $cm^3$ felt pre-metallized with $Ni^{2+}$, the invention uses an electrolyte solution containing copper sulfate at 318 mg/l (concentration of $Cu^{2+}$=0.005 mol/L), sodium sulfate at 0.05 mol/l and boric acid at 0.1 mol/l. The intensity of the current applied is computed as follows:

$$I=i_k\times V_{felt} \text{ with } i_k=0.1 \text{ A/cm}^3.$$

For a 6 $cm^3$ felt, an intensity equal to 600 mA is therefore applied. The flow rate of the solution is maintained at 12 ml/min. The time of imposition of the current is about 8 seconds followed by an idle time of 15 seconds. The volume of the tank containing the copper solution is 1 liter (l). For a flow rate of 12 ml/min, the time of passage of a liter of solution through a face of the felt is 80 minutes. The number of cycles is four and this corresponds to a total electrolysis time of 320 min. At the end of each cycle, the $Cu^{2+}$ concentration is readjusted to its initial value by the addition of 10 ml of a copper solution at 0.5 mol/l in the tank. The disappearance of blue color of the copper ions after each cycle justifies the readjustment of the solution.

It is furthermore quite remarkable that mathematical relationships regulating the flow rate and the time of imposition of the current by a first metallization can be applied to the electrodeposition on a pre-metallized felt.

Example 3

Metallization of a Graphite Felt by Cobalt

Metallization with cobalt requires conditions stricter than those for nickel owing to their difference in chemical reactivity. In particular, the pH factor must be kept at a value of 5 to 6. The dimensions of the felt are 24 cm×14 cm×0.3 cm. The volume of the felt is approximately 100 $cm^3$. Two 10-liter tanks are connected to the metallization reactor. A first tank is filled with a solution of cobalt sulfate in a concentration in $Co^{2+}$ equal to 150 mg/l. The electrolyte solution furthermore contains a support electrolyte consisting of sodium sulfate in a concentration 0.5 mol/l and boric acid in a concentration of 0.1 mol/l. The intensity of the current applied is 10 A. The time of imposition of the current is 30 seconds followed by an idle time of 60 seconds. The flow rate of the electrolyte solution is kept at 100 ml/min. Between each cycle, the pH factor of the solution is adjusted to a value ranging from 5 to 6 by the addition of a few milliliters of a solution of sodium hydroxide at 10 mol/l. The concentration in $Co^{2+}$ is also adjusted by the addition of a few milliliters of a solution of cobalt sulfate at 1 mol/l. Thus, a metallized felt is obtained supporting a mass of cobalt of about 8 g. The thickness of the coating of the fibers by nickel is of the order of 200 nm. The total time of electrolysis is 600 min, comprising 200 min of cumulated electrolysis time and 400 min of cumulated idle time.

The operational conditions, especially the number of cycles that need to be implemented to obtain an adequate quality of metallization can be determined by implementing optimization trials. These optimization trials are conducted in taking account of the embodiments described here above.

6.5 Variants

A metallized or metallizable felt obtained through the method according to the invention can also be applied in a method for treating water polluted by metals. Indeed, electrodeposition on felt enables swift trapping of the metal ions present in wastewater or polluted groundwater tables. The patent application EP-B1-0302891 describes a method for the treatment by electrodeposition in percolation using graphite particles for the depollution of effluents. According to this technique, the water charged with pollutant ions circulates through electrodes constituted by graphite particles subjected to electric current. However, the pressure exerted on the particles constituting the electrode by the movement of the electrolyte solution causes a continual displacement of these particles. The combination of high pressure exerted by the liquid and erosion prompted by mutual friction between the particles leads to a high heterogeneity of the metallized depot on the surface and inside the electrode. Particularly susceptible areas of deposition are rapidly formed, leading to a clogging of the electrode. These technologies were therefore abandoned after the 1980s. The use of a felt, owing to its fiber structure and its high mechanical resistance, averts these phenomena of poor conductivity between particles and of clogging.

The method according to the invention can also notably be implemented for obtaining metal foils that can be used as an electrode support, for accumulators and the fuel cells.

The invention claimed is:

1. Method for manufacturing a metallized or metallizable felt by percolation of at least one felt element by electrodeposition comprising:

a step for maintaining said at least one felt element in a metallization reactor comprising a support, wholly or partly made of electrically conductive material, for said at least one felt element and defining a first compartment and a second compartment separated by said at least one felt element, said support being electrically linked to a counter-electrode;

a step in which an electrolyte solution comprising at least one electroactive metal ion salt is made to travel through said at least one felt element;

a step for making at least one electric current pass through said at least one felt element;

said step for making an electrolyte solution travel through said at least one felt element consisting in making at least a part of this electrolyte solution pass at least once in a direction going from said first compartment to said second compartment and in the reverse direction going from the second compartment to said first compartment of said metallization reactor; and said first compartment is placed in fluid communication with a first tank and in that said second compartment is placed in fluid communication with a second tank, the electrolyte solution travelling at least once via said compartments of said reactor in a path going from said first tank to said second tank and from said second tank to said first tank.

2. Method according to claim 1 wherein said at least one the felt element is a graphite felt element.

3. Method according to claim 1 characterized in that the method comprises a preliminary step of pre-metallization of said at least one felt element.

4. Method according to claim 1 characterized in that said electroactive metal ion is chosen from among the elements of the periods 4 to 6 of the periodic table.

5. Method according to claim 1 characterized in that said electrolyte solution has a concentration in electroactive metal ions salt ranging from 50 mg/l to 10 g/l.

6. Method according to claim 1 characterized in that said step for making an electric current pass through said at least one felt element is carried out by using an electric current the intensity of which is proportional to the volume of said at least at least one felt element according to the formula:

$$I=i_k\times V_{felt}$$

where I is the intensity of the current in amperes, $i_k$=0.1 A/cm$^3$ $V_{felt}$ is the volume of the felt in cm$^3$.

7. Method according to claim 1 characterized in that said at least one felt element has a thickness of 1 mm to 6 mm and in that said step for making an electrolyte solution pass through said at least one felt element is implemented according to a maximum flow rate $d_{max}$ of the electrolyte solution computed according to the following formula:

$$d_{max}=2\times V_{felt}/a$$

where $d_{max}$ is expressed in ml/min, $V_{felt}$ is the volume of the felt in cm$^3$, and a is equal to 1 min.

8. Method according to claim 1 characterized in that said at least one felt element has a thickness of 6 mm to 12 mm and in that the step for making an electrolyte solution pass through said at least one felt element is implemented at a maximum flow rate $d_{max}$ of electrolyte solution computed according to the following formula:

$$d_{max}=V_{felt}/a$$

where $d_{max}$ is expressed in ml/min, $V_{felt}$ is the volume of the felt in cm$^3$, and a is equal to 1 min.

9. Method according to claim 1 characterized in that said step for making an electric current pass through said at least one felt element is interrupted by idle times during which the intensity of the current is zero.

10. Method according to claim 9 wherein said idle time between each imposition of current is computed according to the relationship:

$$t_r=\frac{V_{felt}}{nd}\times 60$$

where $t_r$ is the idle time between each imposition of current in seconds, $V_{felt}$ is the volume of the felt in cm$^3$, n is an integer, d is the flow rate of the electrolyte solution in ml/min.

11. Method according to claim 9 wherein said time of imposition of the current is computed according to the relationship:

$$t_i=\frac{t_r}{2}$$

where $t_i$ is the time of imposition of the current in seconds, $t_r$ is the idle time between each imposition of current in seconds.

12. Method according to claim 4 characterized in that said electroactive metal ion is chosen from among nickel, copper, cobalt, silver, bismuth or lead.

* * * * *